US011407625B2

(12) United States Patent
Holmes

(10) Patent No.: US 11,407,625 B2
(45) Date of Patent: Aug. 9, 2022

(54) DEVICE THAT WILL HELP LIFT AN OBJECT THAT'S HEAVY OR LIGHT

(71) Applicant: Lonnie Holmes, Coram, NY (US)

(72) Inventor: Lonnie Holmes, Coram, NY (US)

( * ) Notice: Subject to any disclaimer, the term of this patent is extended or adjusted under 35 U.S.C. 154(b) by 264 days.

(21) Appl. No.: 16/798,295

(22) Filed: Feb. 21, 2020

(65) Prior Publication Data

US 2020/0270108 A1 Aug. 27, 2020

Related U.S. Application Data

(60) Provisional application No. 62/810,515, filed on Feb. 26, 2019.

(51) Int. Cl.

| | |
|---|---|
| ***B66F 19/00*** | (2006.01) |
| ***H04R 9/04*** | (2006.01) |
| ***H04R 9/06*** | (2006.01) |
| ***H04R 7/12*** | (2006.01) |

(52) U.S. Cl.

CPC ..... *B66F 19/00* (2013.01); *H04R 7/12* (2013.01); *H04R 9/046* (2013.01); *H04R 9/06* (2013.01)

(58) Field of Classification Search

CPC ..... B66F 19/00; H04R 7/12; H04R 9/046; H04R 9/06; B66C 1/0212; G10K 15/00

See application file for complete search history.

(56) References Cited

U.S. PATENT DOCUMENTS

| | | | | |
|---|---|---|---|---|
| 4,284,403 | A * | 8/1981 | Rey | G10K 11/20 73/570.5 |
| 4,549,435 | A * | 10/1985 | Barmatz | F16C 32/00 73/570.5 |
| 5,036,944 | A * | 8/1991 | Danley | G10K 15/00 73/570.5 |
| 6,647,791 | B1 * | 11/2003 | Hoppner | H01L 21/68 73/570.5 |
| 9,602,901 | B2 * | 3/2017 | Lee | H04R 1/026 |
| 11,041,878 | B2 * | 6/2021 | Todter | G01R 33/0017 |
| 2016/0157002 | A1 * | 6/2016 | Chen | H04R 1/028 320/108 |

FOREIGN PATENT DOCUMENTS

| | | | | |
|---|---|---|---|---|
| WO | WO-2018128374 A1 * | 7/2018 | | H02N 15/00 |

* cited by examiner

*Primary Examiner* — Angelica M McKinney
(74) *Attorney, Agent, or Firm* — Alfred M. Walker

(57) ABSTRACT

A method of lifting an object, includes the steps of using a flexible sound producing speaker cone mechanism and generating and directing an acoustic sound. The sound thus generated has a predetermined frequency, imparted on the object, at various object locations. The acoustic sound communicates through first and second coils associated with the sound producing mechanism, such as a conical rubber member associated with the coils. The first coil harnesses electrical current and the second coil harnesses frequency, producing a force causing the rubber sound producing speaker cone mechanism to expand its surface area and push air outward. The pushed air provides a force for imparting movement of an object in the vicinity of the flexible sound producing speaker cone mechanism. Lifting by air is augmented by magnetic fields generated.

1 Claim, 3 Drawing Sheets

DEVICE THAT WILL HELP LIFT AN OBJECT THAT'S HEAVY OR LIGHT

BACKGROUND OF THE INVENTION

Problem Solved

It will help lift an object that is heavy or light.

Other devices use combustion or other power motor sources.

No fuel is needed and there is less weight to move.

DETAILED DESCRIPTION OF THE INVENTION

As stated above, it will help lift an object that is heavy or light. The invention claimed here solves this problem.

It will pump air out of a flexible acoustic speaker to lift an object using magnetic frequency.

The claimed invention is an improvement on what currently exists. It is different because it is a large pump. It is light and easy to move.

Other products require too much fuel, which adds weight.

No fuel for combustion power or electrical power is needed, and there is less weight to move.

Also, it can be integrated into anything and everything that can be reinvented.

The preferred version of the present invention includes a rubber pump speaker coil.

Relationship Between the Components

The rubber speaker cone coil pump includes an exterior stationary coil and a movable reciprocating coil within the rubber speaker cone coil pump.

How the Invention Works

The rubber speaker cone with coil moves up and down pushing air out and in. This action is cause by two speaker coils. The first coil is connected to the rubber speaker cone. The second coil stands alone connected to the speaker casing. Both coils work together; one coil harnesses frequency, the other harnesses electrical current.

The rubber speaker cone coil design is like a sound speaker that plays music.

How to Make the Invention

This invention is made like a speaker without a magnet.

The rubber speaker cone with a movable reciprocating coil is necessary for pushing, and a stationary coil connected to a casing is necessary for supplying electrical current.

The components can be used like a speaker as well.

How to Use the Invention

The rubber speaker cone is used for moving something too heavy.

Additionally, it can allow an object to levitate whether the object is small or of a great size or weight.

Also, it can lift anything and everything that can be lifted.

DESCRIPTION OF THE DRAWINGS

The present invention can best be understood in connection with the accompanying drawings. It is noted that the invention is not limited to the precise embodiments shown in the following drawings, in which.

Figure 1:
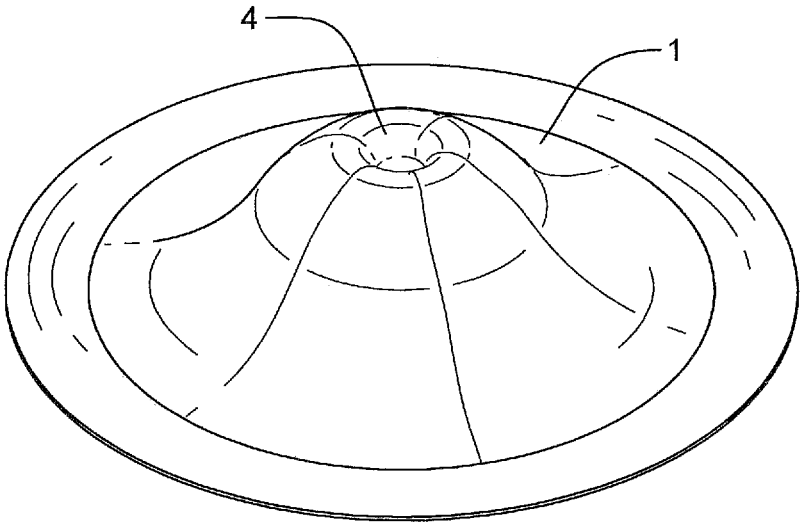
FIG. 1 is an isometric view from above of the flexible sound producing speaker cone mechanism 1 with a central concave well 4 for generating and directing an acoustic sound at a predetermined frequency, imparted on an object.
Figure 2:
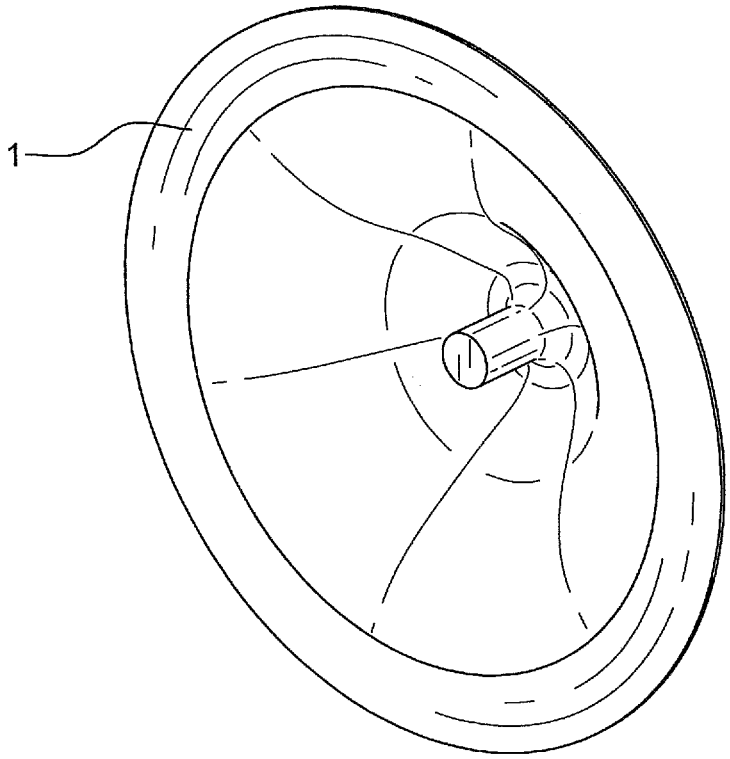
FIG. 2 is an isometric view from below of the flexible sound producing speaker cone mechanism 1 for generating and directing an acoustic sound at a predetermined frequency, imparted on an object.
Figure 3:
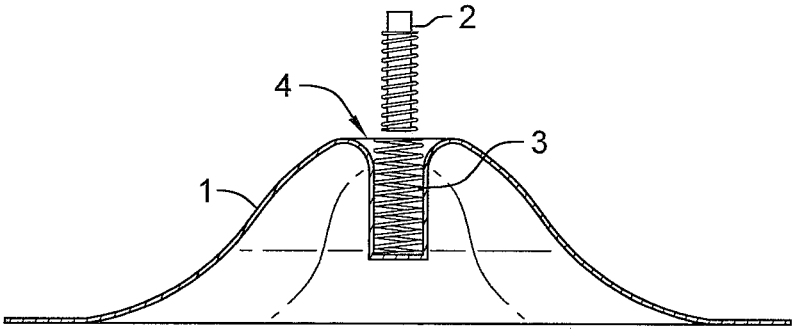
FIG. 3 is a cross sectional view of the flexible sound producing speaker cone mechanism 1 for generating and directing an acoustic sound at a predetermined frequency, imparted on an object, taken along a mid-point slice view thereof, wherein a central concave well, preferably cylindrical, accommodates an axially movable coil 3 therein, in response to a second stationary coil 2 having electric current passed therethrough for creating a magnetic field between a movable coil 3 and the stationary coil 2, wherein further the flexible sound producing speaker cone mechanism expands upward.
Figure 4:
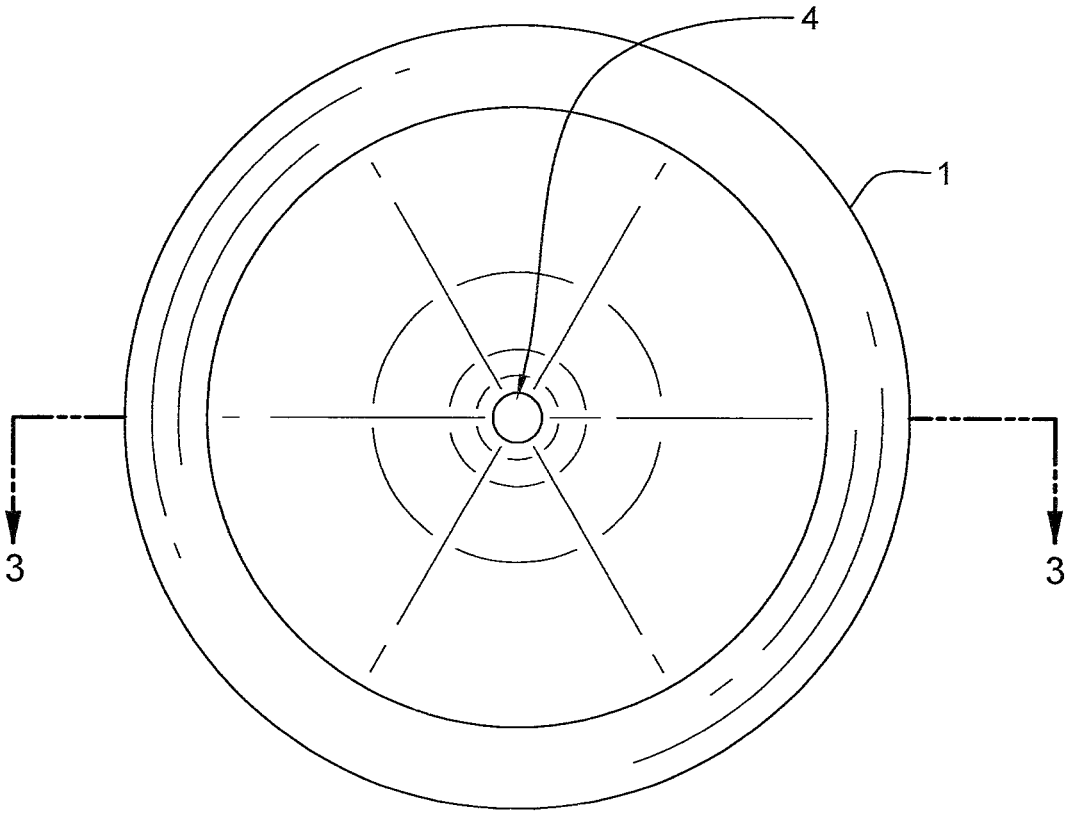
FIG. 4 is a top plan view of the flexible sound producing speaker cone mechanism 1 for generating and directing an acoustic sound at a predetermined frequency, imparted on an object, and showing the concave well 4 accommodating the axially movable coil 2 therein.
Figure 5:
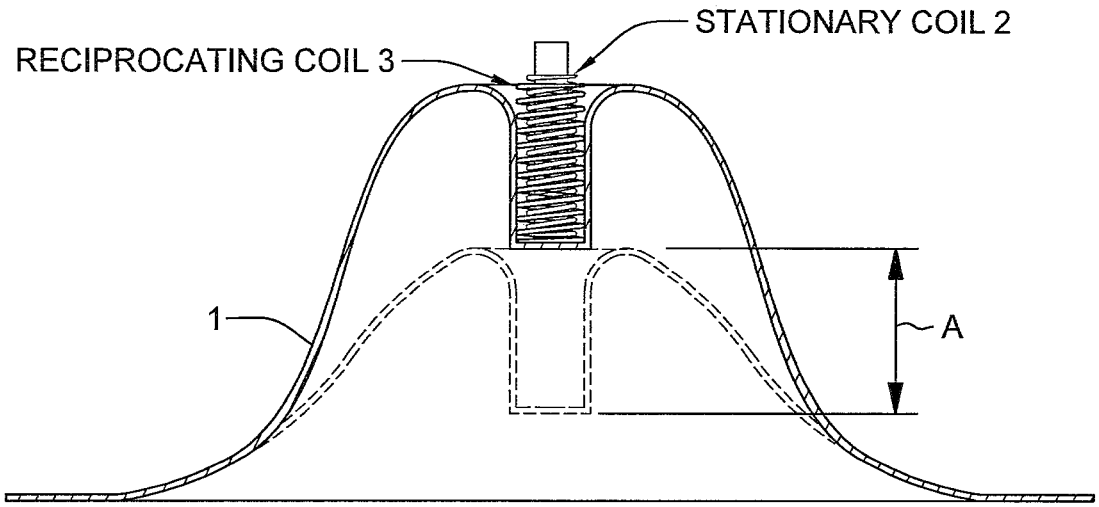
FIG. 5 shows the first coil 2 and second coil 3 through which the acoustic sound communicates in association with the conical rubber sound producing mechanism 1. Coil 2 is stationary and supplies electrical current. Coil 3 is reciprocally movable up and down in the direction of movement arrows "A", due to magnetic fields between coil 2 and coil 3, within the central well 4 of the flexible sound producing speaker cone mechanism 1, when movable coil 3 is exposed to stationary electrified coil 2. Flexible sound producing speaker cone mechanism 1, stationary coil 2 and movable coil 3 are known to those persons skilled in the art of acoustics and magnetic fields.

No fossil fuel is required and the system reduces weight of lifting machines.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claim.

What is claimed is:

1. A method of lifting an object, comprising the steps of:

using a flexible sound producing speaker cone mechanism, generating and directing an acoustic sound, the acoustic sound having a predetermined frequency, imparted on the object, at various object locations, wherein the acoustic sound communicates through first and second coils associated with the flexible sound producing speaker cone mechanism, wherein said first coil harnesses electrical current and said second coil harnesses frequency, producing a magnetic force field causing the flexible sound producing speaker cone mechanism to expand its surface area and push air outward, said pushed air and magnetic force field providing a force for imparting movement of the object in the vicinity of the flexible sound producing speaker cone mechanism.

* * * * *